US009888758B2

(12) United States Patent
Alexander et al.

(10) Patent No.: US 9,888,758 B2
(45) Date of Patent: Feb. 13, 2018

(54) NAIL DRYER

(71) Applicant: Gulfstream Inc., Cambridge (CA)

(72) Inventors: Chris Alexander, Ontario (CA); Minh Sang Tran, Cambridge (CA)

(73) Assignee: Gulfstream Inc., Cambridge, CA (US)

( * ) Notice: Subject to any disclaimer, the term of this patent is extended or adjusted under 35 U.S.C. 154(b) by 332 days.

(21) Appl. No.: 14/626,718

(22) Filed: Feb. 19, 2015

(65) Prior Publication Data

US 2015/0230582 A1 Aug. 20, 2015

Related U.S. Application Data

(60) Provisional application No. 61/941,657, filed on Feb. 19, 2014.

(51) Int. Cl.
*F26B 5/00* (2006.01)
*A45D 29/00* (2006.01)

(52) U.S. Cl.
CPC ..... *A45D 29/00* (2013.01)

(58) Field of Classification Search
CPC ..... A45D 29/00; A61Q 3/00
USPC ..... 34/443, 510; 132/73, 73.6
See application file for complete search history.

(56) References Cited

U.S. PATENT DOCUMENTS 8,450,705 B1 * 5/2013 Chen ..... F26B 3/28 250/492.1
2006/0260628 A1 * 11/2006 Chan ..... A45D 29/00 132/73
2015/0184937 A1 * 7/2015 Hywel ..... F26B 9/066 34/202

* cited by examiner

*Primary Examiner* — John McCormack
(74) *Attorney, Agent, or Firm* — Avery N Goldstein; Blue Filament Law, PLLC

(57) ABSTRACT

An impeller an axis passing through a void and blades extending from the void. A housing: has a planar terminus defined by the housing; is rotatably mounted to the impeller such that, when the housing is positioned with the terminus horizontal and defining the housing bottom, the axis extends vertically and the impeller is above the terminus. The housing has a tubular sidewall: through which the axis extends and in which the impeller is positioned; shaped and dimensioned such that a gap is defined between the sidewall and a notional plane aligned with the terminus to direct air flow ejected from the impeller through the gap. The housing further has a screen occluding the sidewall end distal to the terminus, adapted to allow throughpassage of air and to restrict throughpassage of fingers and such that the screen has a portion that lies in the void. A motor rotates the impeller.

7 Claims, 7 Drawing Sheets

NAIL DRYER

FIELD OF THE INVENTION

The invention relates to the field of nail dryers.

BACKGROUND OF THE INVENTION

In the manicure industry, nail dryers are widely used. It is desirable for a nail dryer to be relatively quiet, to be relatively efficient to run in terms of power costs and to dry nails relatively quickly.

SUMMARY OF THE INVENTION

A nail dryer forms one aspect of the invention. The nail dryer comprises: a squirrel cage impeller, a housing and a motor.

The impeller has a central void, an axis passing through the central void and a plurality of blades extending outwardly from the central void.

The housing: has a planar terminus defined by three or more portions of the housing; and has the impeller operatively rotatably mounted thereto such that, when the housing is positioned with the terminus horizontal and defining the bottom of the housing, the axis extends vertically and the impeller is above the terminus.

The housing further has a tubular sidewall:

- through which the axis extends and in which the impeller is positioned in spaced-apart relation;
- being shaped and dimensioned such that a gap is defined between the sidewall and a notional plane aligned with the terminus; and
- being further shaped and dimensioned to direct air flow ejected from the impeller through the gap.

The housing further has a screen occluding the end of the sidewall distal to the terminus, the screen being adapted to allow the throughpassage of air and to restrict the throughpassage of fingers.

The housing is shaped and dimensioned such that the screen has a portion that lies in the central void of the impeller.

The motor is for rotating the impeller.

According to another aspect of the invention, the end of the sidewall distal to the terminus can extend beyond the impeller.

According to another aspect of the invention, the motor can be positioned axially displaced from the impeller such that, when the housing is positioned with the terminus horizontal and defining the bottom of the housing, the motor is beneath the impeller.

According to another aspect of the invention, the sidewall can have a concave interior surface.

According to another aspect of the invention, the screen can be a round dish having a concave exterior surface and a concave interior surface.

According to another aspect of the invention, the impeller can have forward-curved blades. According to another aspect of the invention, the impeller can have a closed base.

Advantages, features and characteristics of the present invention will become evident upon review of the detailed description that follows and the accompanying drawings, the latter being briefly described hereafter.

DETAILED DESCRIPTION OF THE EXEMPLARY EMBODIMENT

Figure 1:
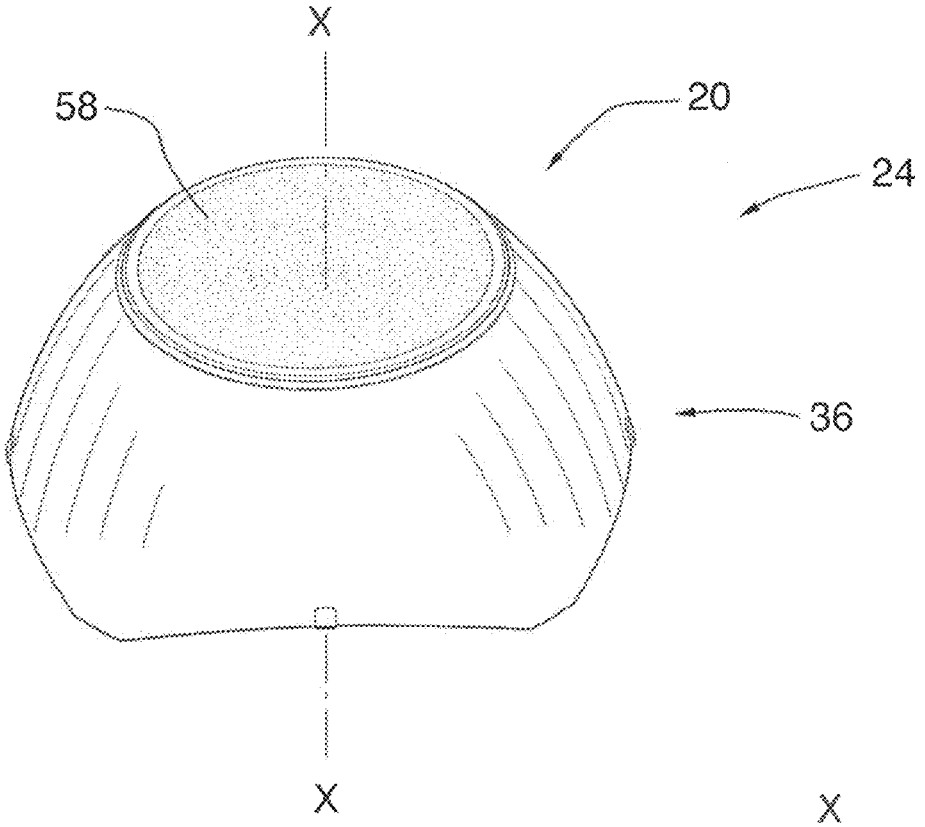
FIG. 1 is a top perspective view of a nail dryer according to an exemplary embodiment of the invention.
Figure 2:
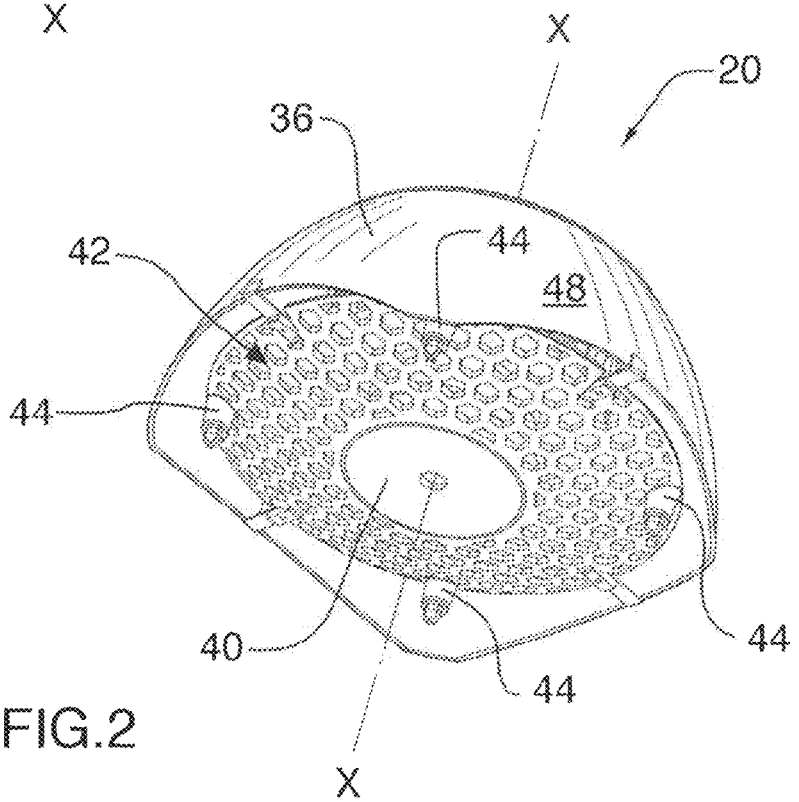
FIG. 2 is a bottom perspective view of the nail dryer of FIG. 1.
Figure 3:
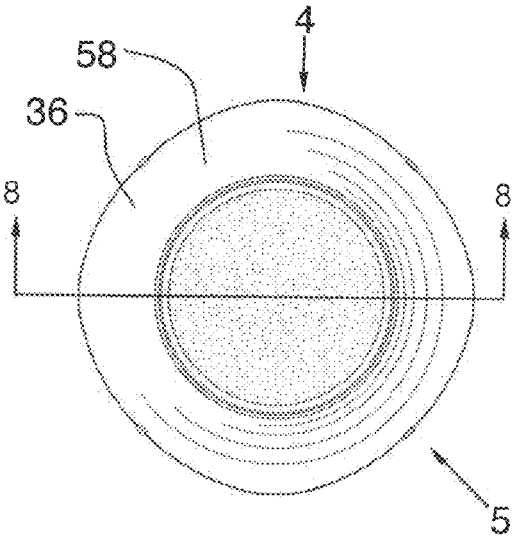
FIG. 3 is a top view of the nail dryer of FIG. 1.

The exemplary nail dryer 20 shown in FIGS. 1-8 will be seen to include an impeller 22, a housing 24 and a motor 26.

The impeller 22 is of the squirrel cage type and thus has a central void 28, an axis X-X passing through the central void 28 and a plurality of blades 30 extending outwardly from the central void 28. The blades 30 are curved and are connected to one another by an annular disc 32 that forms a base of the impeller 22.

The housing 24 has a base 34, a sidewall 36 and a screen 38.

Figure 4:
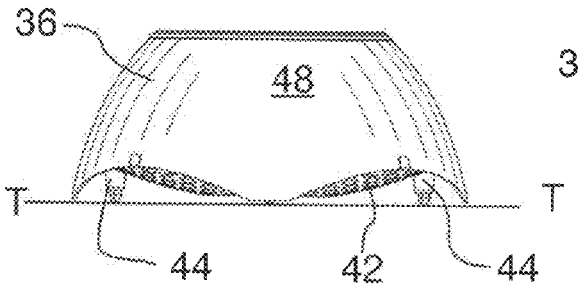
FIG. 4 is a view along arrow 4 of FIG. 3.
Figure 5:
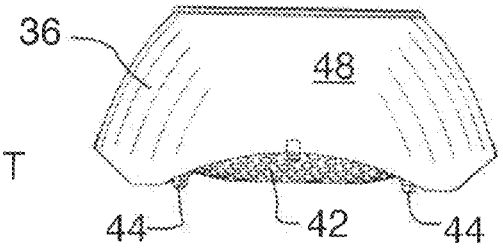
FIG. 5 is a view along arrow 5 of FIG. 3.
Figure 6:
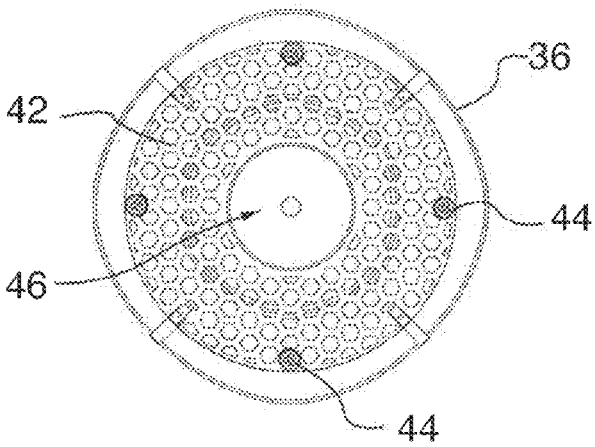
FIG. 6 is a bottom view of the nail dryer of FIG. 1.
Figure 7:
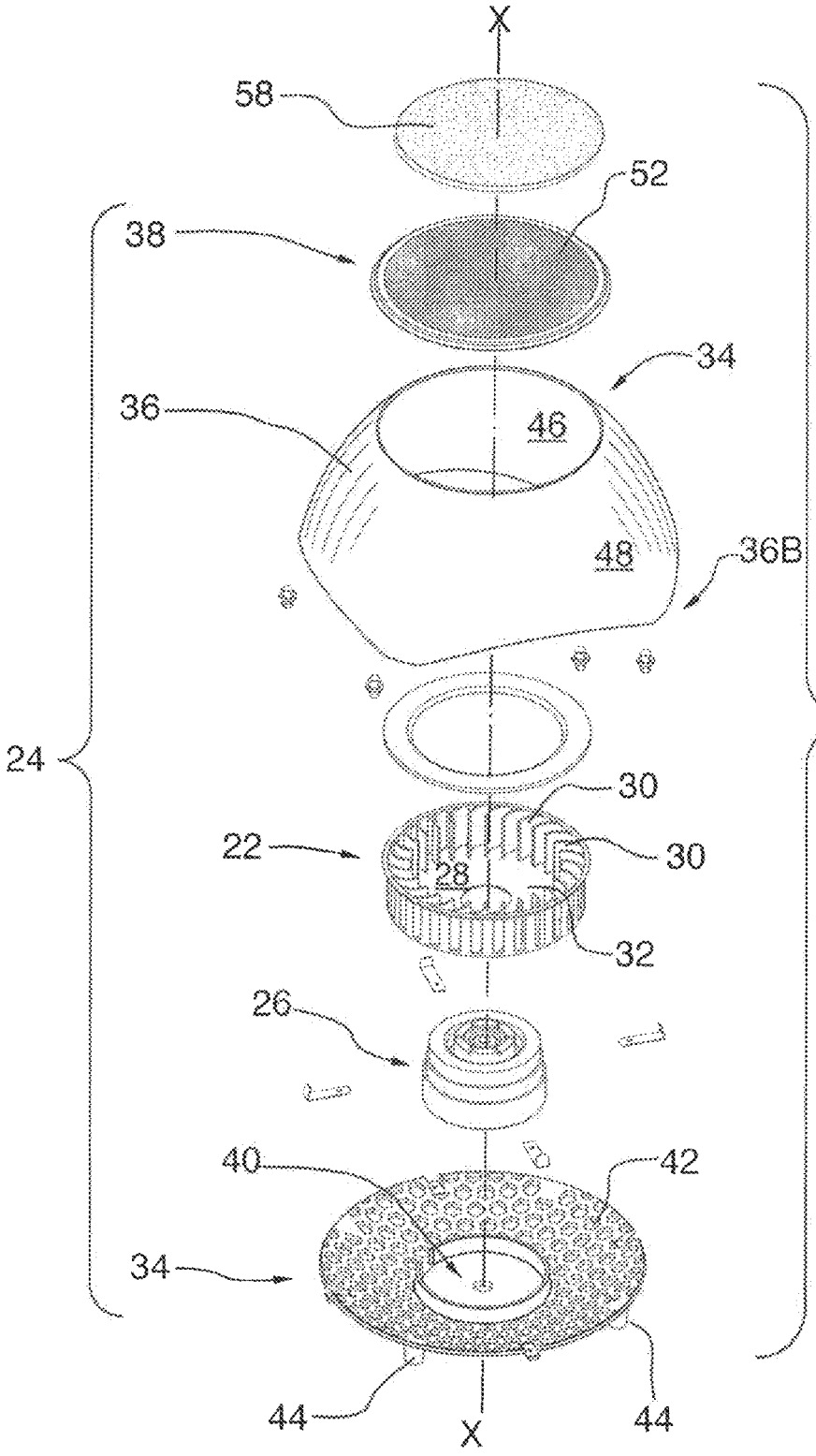
FIG. 7 is an exploded view of the nail dryer of FIG. 1.

The base 34 has a central socket 40, an annular screen 42 surrounding the socket 40 and four feet 44 extending from the screen 42. The feet 44 collectively define a planar terminus of the housing, that is, the ends of the feet 44 lie in a common plane and all of the housing 24 lies on the same side of that plane. Plane T-T shown in FIG. 4 shows such a plane. The base 34 is positioned relative to impeller 22 such that, as shown in FIG. 8, with the terminus 44,44,44,44 of the housing 24 orientated to lie in the horizontal plane and defining the bottom of the housing 24, the impeller 22 is above the terminus 44,44,44,44 and the axis X-X extends vertically.

Figure 8:
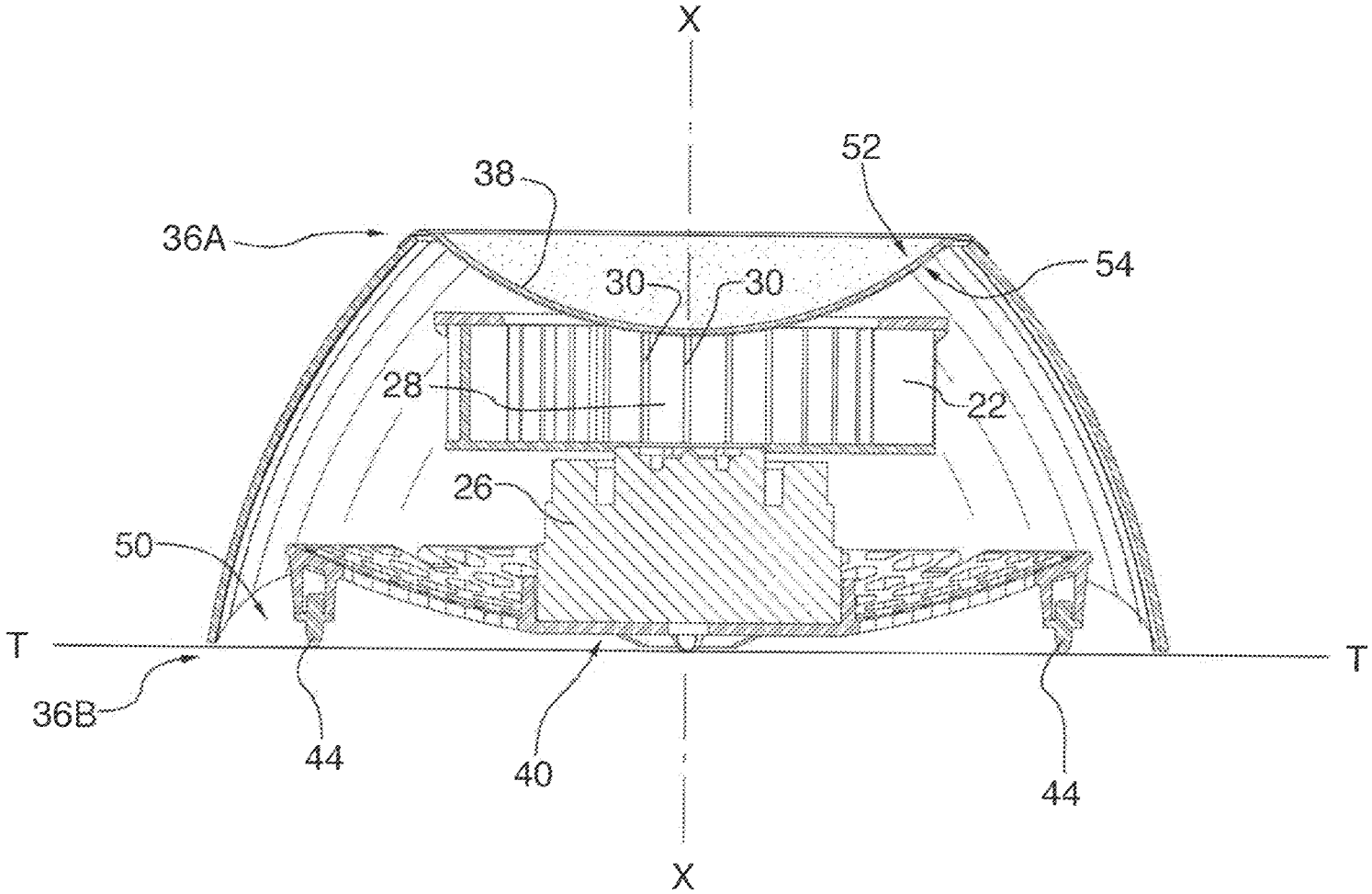
FIG. 8 is a view along section 8-8 of FIG. 3.

The sidewall 36: is tubular; has a concave interior surface 46 and a convex exterior surface 48; is positioned such that the axis X-X extends therethrough; has ends 36A,36B spaced-apart from one another along the axis X-X; is further positioned such that the impeller 22 is positioned therein, in spaced-apart relation; and is positioned, shaped and dimensioned:

- such that a gap 50 is defined between the end 36B of the sidewall 34 proximal to the terminus 44,44,44,44 and a notional plane aligned with the terminus 44,44,44,44, such as indicated by plane T-T;
- such that the end 36A of the sidewall 36 distal to the terminus 44,44,44,44 extends beyond the impeller 22, as shown in FIG. 8; and
- to direct air flow ejected from the impeller 22 through the gap 50.

Figure 9:
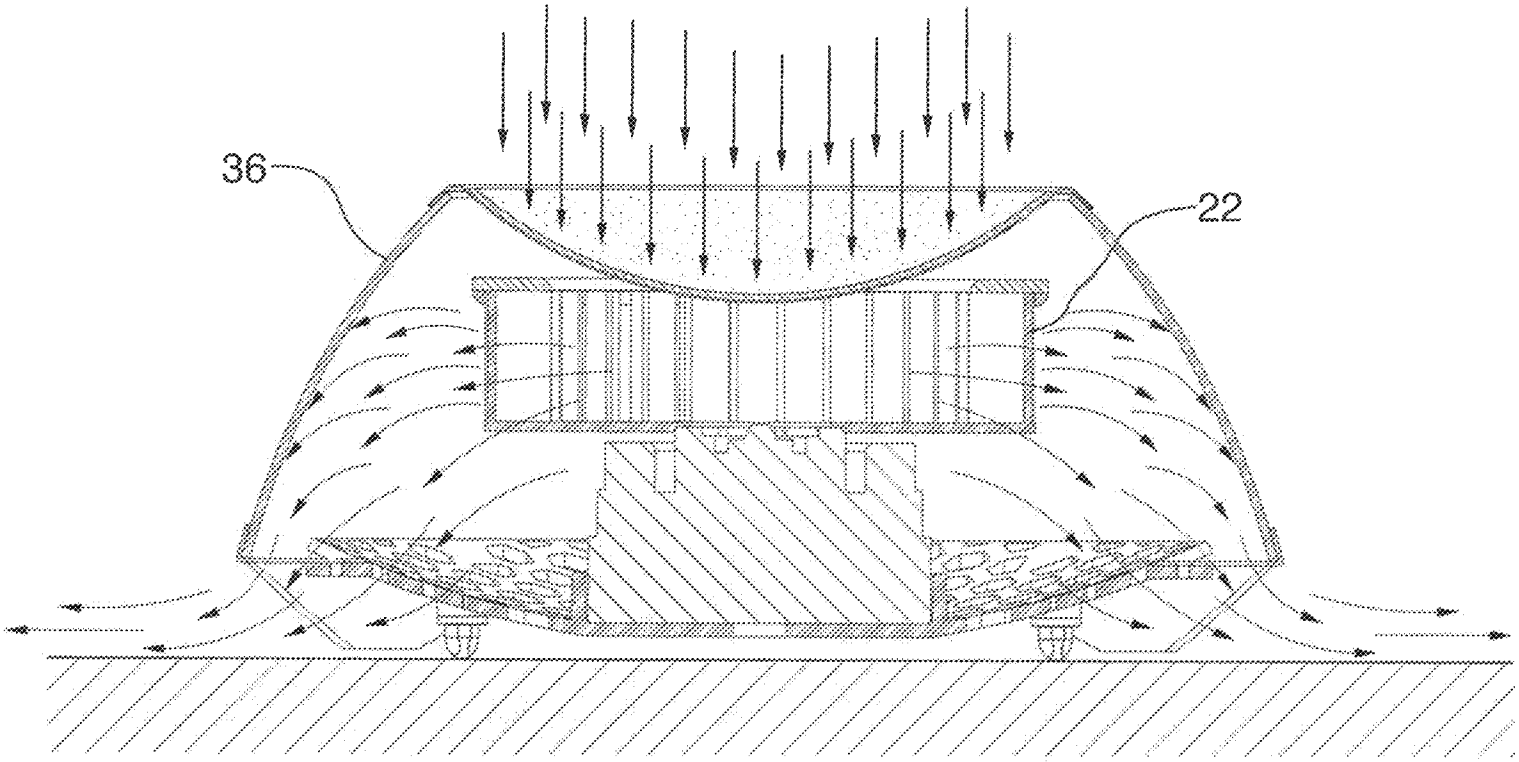
FIG. 9 is a schematic view similar to FIG. 8 showing the nail dryer in use.

The gap 50 is indicated in FIG. 8 and will be understood to be defined in part, in the illustrated embodiment, by arcuate notches in the sidewall, which otherwise extends substantially entirely to the terminus 44,44,44,44; the fan is shown in use in FIG. 9 and it will be seen that the sidewall 36 stops just short of the surface upon which the fan rests .

The screen 38: is a round dish; has a concave exterior surface 52 and a convex interior surface 54; occludes the end 36A of the sidewall 36 distal to the terminus 44,44,44,44; is adapted to allow the throughpassage of air and to restrict the throughpassage of fingers; and has a portion that lies in the central void 28 of the impeller 22, again as shown in FIG. 8.

The motor 26 is mounted in the central socket 40, is axially displaced from and beneath the impeller 22 and is adapted for rotating the impeller 22 in a direction such that the blades 30 are forward-curved.

The exemplary nail fan 20 has been tested for noise and throughput and has demonstrated substantial utility, producing between 125 and 145 CFM flow through the screen while producing relatively little noise: measured at 12" and 24" respectively from the fan, was 70 dba and 68 dba.

The draw of the fan is sufficiently great that a gauze pad 58 or the like, as shown in the drawings, can be used to support the fingers during drying, to collect nail and skin debris and also to protect the screen against polish.

Figure 10:
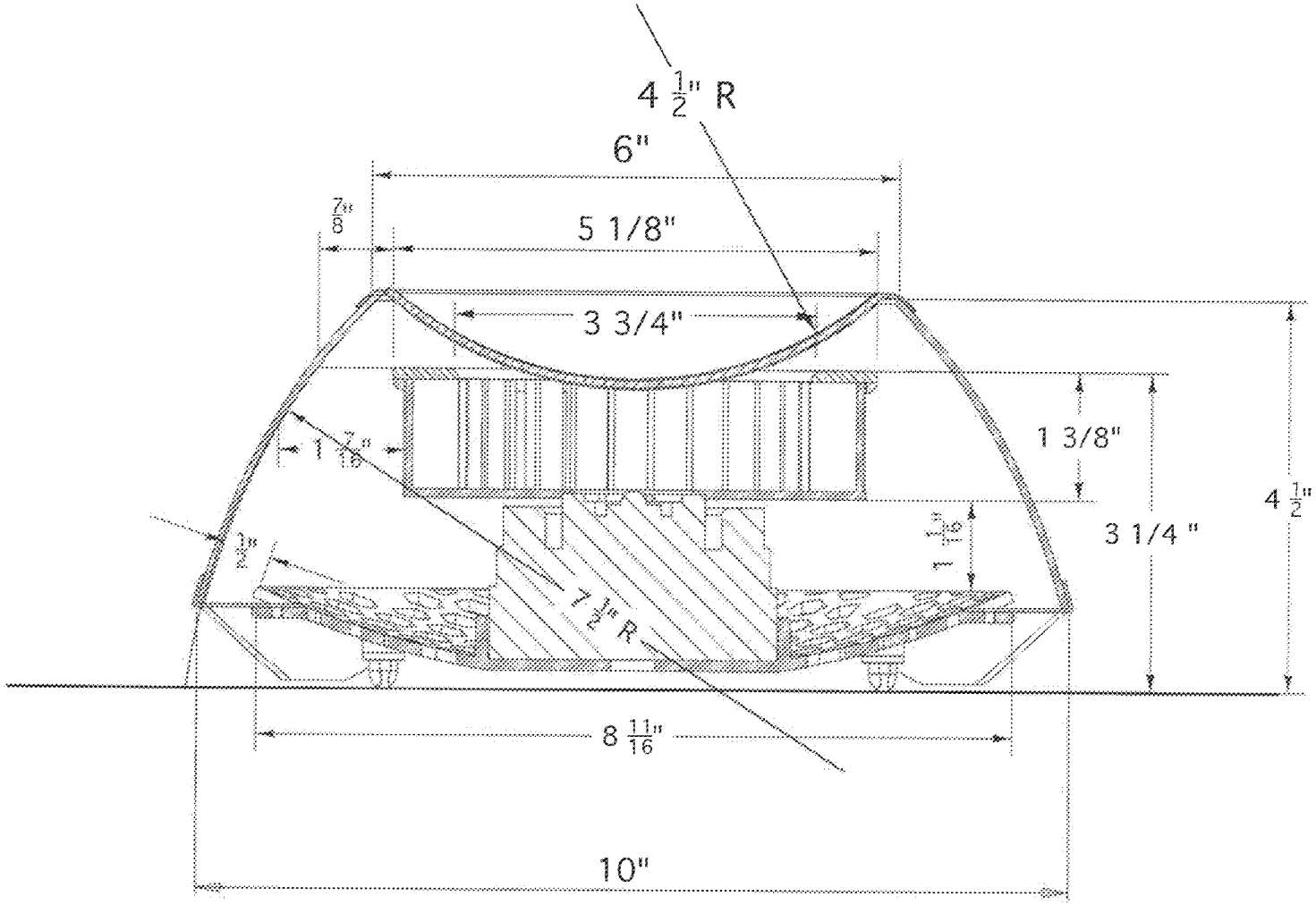
FIG. 10 is a dimensioned view of FIG. 8.
Figure 11:
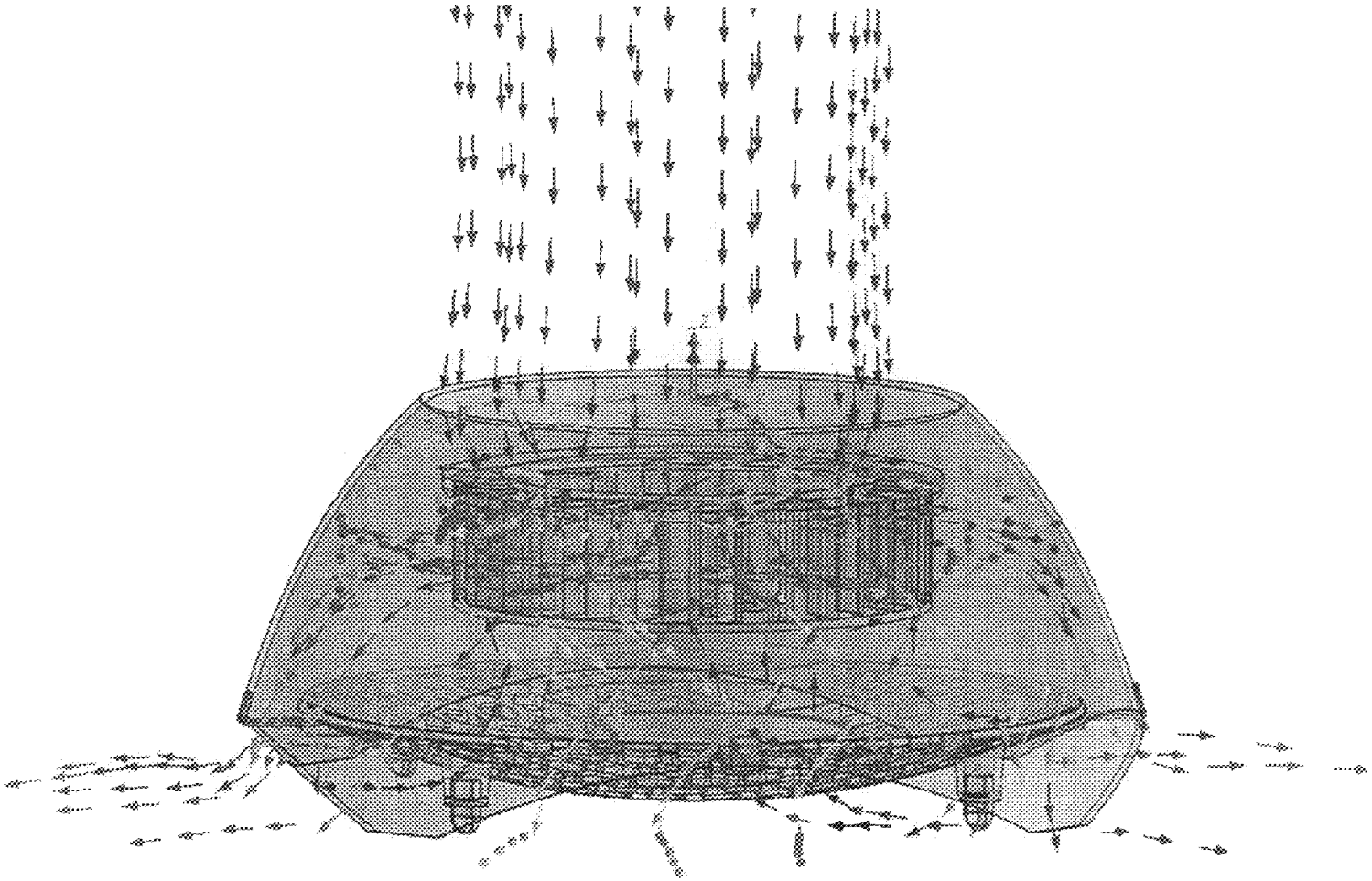
FIG. 11 is a view produced by computational fluid dynamics showing the airflow produced by the nail dryer of FIG. 1

Without intending to be bound by theory, it is believed that the relatively high draw and low noise may be a function of very smooth flow characteristics. In this regard, the CFD simulation in FIG. 11 shows that ingress and egress flows are very uniform and smooth. This uniformity may be a result of the specific geometry of the sidewall 36, screen 38 and impeller 22. Accordingly, FIG. 10 shows representatives dimensions and radii of curvature.

Whereas but a single embodiment has been herein shown and described, it will be evident that variations are possible. For example, whereas in the exemplary fan, the blades are forward curved, the blades could be straight or could be reverse-curved. As well, the base could have feet greater or lesser in number than four. Further, the screen could be flat bottomed and could bottom out just above the impeller. The size and shape of the fan and its various components could also be varied from the specific embodiment illustrated. Accordingly, the invention should be understood as limited only by the accompanying claims, purposively construed.

The invention claimed is:

1. A nail dryer comprising:

a squirrel cage impeller having a central void, an axis passing through the central void and a plurality of blades extending outwardly from the central void;

a housing:

having a planar terminus defined by three or more portions of the housing;

to which the impeller is operatively rotatably mounted such that, when the housing is positioned with the terminus horizontal and defining the bottom of the housing, the axis extends vertically and the impeller is above the terminus;

having a sidewall:

through which the axis extends and in which the impeller is positioned in spaced-apart relation;

being shaped and dimensioned such that a gap is defined between the sidewall and a notional plane aligned with the terminus; and being further shaped and dimensioned to direct air flow ejected from the impeller through the gap;

having a screen occluding the end of the sidewall distal to the terminus, the screen being adapted to allow the throughpassage of air and to restrict the throughpassage of fingers; and shaped and dimensioned such that the screen has a portion that lies in the central void of the impeller; and a motor for rotating the impeller.

2. The nail dryer according to claim 1, wherein the end of the sidewall distal to the terminus extends beyond the impeller.

3. The nail dryer according to claim 1, wherein the motor is positioned axially displaced from the impeller such that, when the housing is positioned with the terminus horizontal and defining the bottom of the housing, the motor is beneath the impeller.

4. The nail dryer according to claim 1, wherein the sidewall has a concave interior surface.

5. The nail dryer according to claim 1, wherein the screen is a round dish having a concave exterior surface and a concave interior surface.

6. The nail dryer according to claim 1, wherein the impeller has forward-curved blades.

7. The nail dryer according to claim 1, wherein the impeller has a closed base.

* * * * *